United States Patent [19]

Roche

[11] Patent Number: 4,512,106

[45] Date of Patent: Apr. 23, 1985

[54] CABLE FAILURE INDICATOR

[75] Inventor: John N. Roche, Greenville, Pa.

[73] Assignee: American Sterilizer Company, Erie, Pa.

[21] Appl. No.: 567,236

[22] Filed: Dec. 30, 1983

[51] Int. Cl.[3] ..... E05D 13/10

[52] U.S. Cl. ..... 49/445; 16/194

[58] Field of Search ..... 49/445, 447, 448; 16/193, 194

[56] References Cited

FOREIGN PATENT DOCUMENTS 857910 7/1949 Fed. Rep. of Germany ..... 16/194

2363665 6/1975 Fed. Rep. of Germany ..... 49/445

*Primary Examiner*—Philip C. Kannan

*Attorney, Agent, or Firm*—Robert D. Yeager; Andrew J. Cornelius; Christine Ethridge

[57] ABSTRACT

A device for indicating the failure of one of the cables in a redundant cable system for assisting the movement of a closure which includes means for so connecting each of the cables to a counterweight suspended therefrom that the counterweight is maintained at a first distance from the closure when both cables are intact and the counterweight so moves to a second distance from the closure when one of the two cables fails that the counterweight can move into a position for inhibiting the raising of the closure, thereby indicating the failure of one of the cables. The second distance is greater than the first distance. The connecting means is a pivoting member having two arms, each being adapted for sliding attachment to one of the cables.

4 Claims, 5 Drawing Figures

CABLE FAILURE INDICATOR

BACKGROUND OF THE INVENTION

1. Field of the Invention

The present invention relates to redundant cable systems for operating closures and, more specifically, to devices for indicating the failure of one of the cables.

2. Description of the Prior Art

Closures, such as windows or doors, may be suspended from double chains or cables. Conventionally, one cable is attached to each side of the closure. Weights may be attached to the other end of the cables to equalize the strain of the closure. If one of the cables fails, by breaking or becoming disconnected, the closure will stand ajar and may itself become disconnected and fall.

In a redundant cable system, both cables are connected to one side of the closure. The load is reduced by half and the life of the cables is increased. The closure is generally supported in a track or similar device. When one of the cables does fail, the closure does not become ajar. There is little noticeable difference in the operation of the closure. Continued operation, however, places a double stress on the intact cable and poses a risk of injury to the operator who is unaware of the weakened state of the closure suspension mechanism.

There is a need for a device which indicates the failure of one of the cables in a redundant cable system for use with closures which will not place stress on the intact cable. There is a further need for such a device which is safe to operate.

SUMMARY OF THE INVENTION

The present invention provides a device for indicating the failure of one or more of the cables in a redundant cable system for assisting the vertical movement of a closure wherein a counterweight for balancing the closure is suspended from each of at least two cables. The device includes means for so connecting each of the cables to the counterweight that the counterweight is maintained at a first distance from the closure when all cables are intact and the counterweight so moves to a second distance from the closure when at least one of the cables fails that the counterweight can move into a position for inhibiting the raising of the closure, thereby indicating the failure of one of the cables. The second distance is greater than the first distance.

When the closure is suspended from two cables, the connecting means is a member having two arms, each of which is adapted for sliding attachment to one of the cables. The member is so pivotally connected to the counterweight that the cables maintain the arms in such a generally horizontal position when both cables are intact that the counterweight is maintained at the first distance. The pivotal connection permits one of the cables to so slide along the arm to which it is attached when the other of the two cables fails, that the member pivots, moving the arms toward such a generally vertical position that the counterweight moves to the second distance. The inhibiting position is one in which the counterweight comes to so rest on a horizontal surface that the balancing effect of the counterweight on the closure is eliminated when the closure is raised to less than the second distance from the counterweight.

BRIEF DESCRIPTION OF THE DRAWINGS

The following detailed description of the preferred embodiment can be better understood if reference is made to the attached drawings in which.

DETAILED DESCRIPTION OF THE PREFERRED EMBODIMENT

FIGS. 1 through 5 show a device for indicating the failure of one of the cables in a redundant cable system for assisting the raising of a closure.

Figure 1:
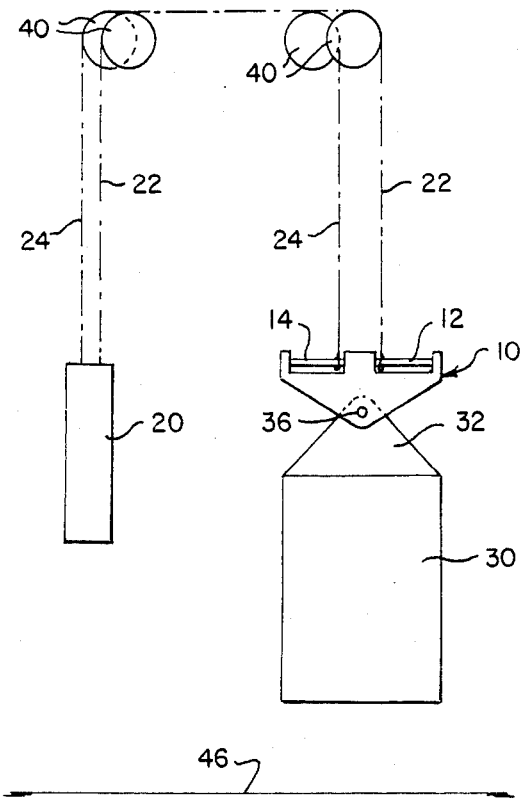
FIG. 1 is a schematic view of the preferred embodiment of the inventionn with both cables intact.
Figure 2:
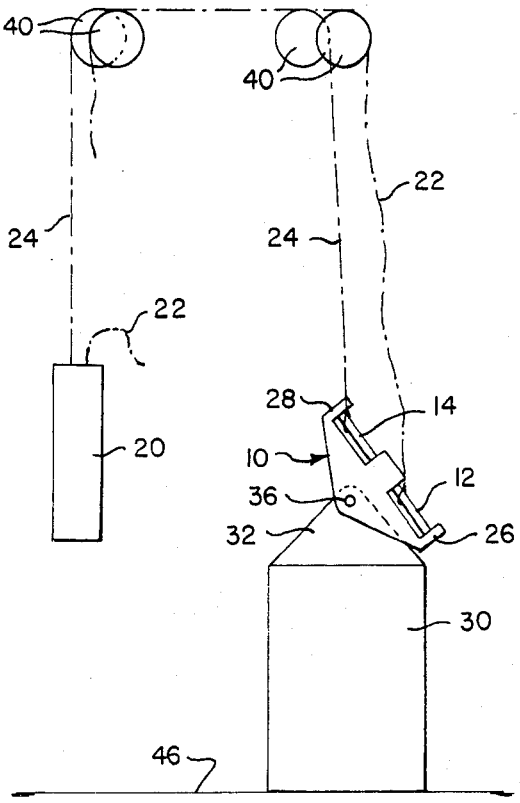
FIG. 2 is a schematic view of the preferred embodiment of the invention with one failed cable.

In the preferred embodiment the device 10 is used with the closure 20 of a sterilization chamber (not shown). The closure 20 covers the opening of the chamber when the closure is in a raised position as illustrated in FIGS. 1 and 2. To uncover the chamber, the closure 20 is lowered. It should be appreciated that the present invention may be used with the closures of products other than sterilization chambers and may be adapted for use with closures which are lowered to cover and raised to uncover an opening.

Referring to FIG. 1, the redundant cable system includes cables 22 and 24, pulley wheels 40, device 10 and counterweight 30. The device 10 connects cables 22 and 24 to the counterweight 30. Device 10 has arms 12 and 14 to which cables 22 and 24, respectively, are attached. Preferably, cables 22 and 24 are so looped around arms 12 and 14, respectively, that each cable 22 or 24 may slide along the corresponding arm 12 or 14 when the arm 12 or 14 pivots as illustrated in FIG. 2. The separate members of each cable 22 and 24 are secured together by a band 42.

Device 10 also includes midsection 18 and end sections 26 and 28. Arm 14 extends from one side of midsection 18 to end section 28. Arm 12 extends in the opposite direction from the other side of midsection 18 to end section 26. Midsection 18 and end sections 26 and 28 prevent the cables 22 and 24 from sliding off arms 12 and 14, respectively. Pins 44 lock arms 12 and 14 into midsection 18. Other suitable known means of securing the arms 12 and 14 to device 10 may be employed without exceeding the scope of the claimed invention. Similar known means may be used to secure arms 12 and 14 to end sections 26 and 28, respectively.

Figure 4:
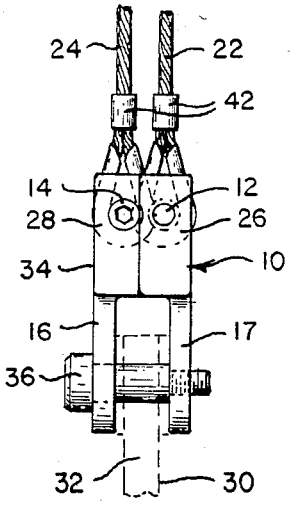
FIG. 4 is a side elevational view of the member shown in FIG. 3.
Figure 5:
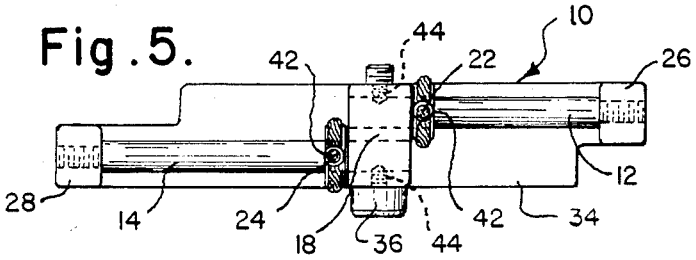
FIG. 5 is a top plan view of the member shown in FIG. 3.

Arms 12 and 14 should lie on parallel lines in the same plane, but need not be colinear with respect to each other, as illustrated in FIGS. 4 and 5. In sterilizers, space is often limited. In order to streamline the cable and pulley wheel arrangement, the illustrated offset arm construction is desirable. A space must be maintained between the corresponding pulley wheels 40 on which cables 22 and 24 move. The cables 22 and 24 must be kept parallel to eliminate shearing forces which would weaken them over time and which could break the tension on the cables 22 and 24. Tension is necessary for proper functioning. Midsection 18 together with the offset parallel arrangement of arms 12 and 14 align cables 22 and 24 appropriately. The weight of counterweight 30 provides the necessary tension to the cables 22 and 24.

Device 10 also includes portion 34 which is pivotally connected to counterweight 30 by screw 36. Portion 34 includes extensions 16 and 17. Recess 38 is defined by extensions 16 and 17.

Counterweight 30 has upper segment 32 which is received into recess 38 in portion 34 between extensions 16 and 17 as shown in FIG. 4. A screw 36 or any other suitable known means may be used to pivotally connect segment 32 between portions 16 and 17. A horizontal surface 46, which may be the actual floor of the sterilizer or a plateau designed to hold counterweight 30, is disposed beneath counterweight 30.

When both cables 22 and 24 are intact, that is unbroken, properly attached to closure 20, aligned on pulleys 40 and attached to device 10, counterweight 30 is suspended as shown in FIG. 1. The arms 12 and 14 of device 10 are in a generally horizontal position. Counterweight 30 is maintained at a first distance from the closure 20. Both cables 22 and 24 are tensioned. In this situation the closure 20 is balanced and moves with ease. When one of the cables 22 and 24 fails, that is, breaks or becomes unattached to closure 20 or device 10, or misaligned with respect to a pulley wheel 40, the remaining intact cable 22 or 24 slides along the arm 12 or 14, respectively, to which it is attached as shown in FIG. 2. Device 10 pivots about screw 36 in such a way that the arm 12 or 14 to which the intact cable 22 or 24, respectively, is attached, pivots away from counterweight 30 toward a generally vertical position. The arm 12 or 14 to which the failed cable 22 or 24, respectively, is attached, pivots toward counterweight 30. FIG. 2 illustrates the situation in which cable 22 has failed and cable 24 remains intact. In that situation, arm 14 pivots away from counterweight 30. Counterweight 30 moves to a second distance from closure 20. The second distance is greater than the first distance. Cable 24 slides to the end of arm 14 and is stopped by end section 28. The vertical distance between closure 20 and counterweight 30 is increased by the pivot of arm 14 and the sliding movement of cable 24 on arm 14.

As long as one or both cables 22 and 24 are in tension with respect to closure 20 and counterweight 30, the closure 20 is balanced by the counterweight 30. When the closure 20 is effectively balanced, the closure 20 can be raised and lowered with relative ease. When one of the cables 22 or 24 fails and the device 10 pivots toward the generally vertical position, there is a momentary lack of tension in the remaining intact cable 22 or 24. When the intact cable 22 or 24 reaches the end of the arm 12 or 14, respectively, along which it slides and the counterweight 30 falls to take up the slack of the increased distance, tension is returned to the intact cable 22 or 24. The closure 20 is again balanced. The pivot of the device 10 which moves the counterweight 30 to the second distance from the closure 20 also moves counterweight 30 closer to horizontal surface 46. When the cable failure occurs while the closure 20 is in a lowered position, the closure 20 can be raised with relative ease for the short distance necessary to lower counterwight 30 onto surface 46. After that point, raising closure 20 any further slackens the remaining intact cable 22 or 24, removes the tension and eliminates the balance on closure 20. Without the balancing effect of counterweight 30, the entire weight of closure 20 must be lifted by the operator. The closure 20 should be heavy enough to require a noticeably increased effort on the part of a reasonably strong person to raise the closure 20 when the balancing effect of counterweight 30 is removed as compared to the effort required when the closure 20 is balanced. The increased effort to raise closure 20 provides an indication to the operator that one of the cables 22 or 24 has failed. If the closure 20 is in the raised position when one of the cables 22 or 24 fails, the counterweight 30 should drop to surface 46 before the slack in the remaining intact cable 22 or 24 is completely taken up so that the closure 20 will fall sharply for a short distance when the operator attempts to lower it until the point where cable 22 or 24 is tensioned again and counterbalance is returned. The closure 20 should have other locking means to maintain complete closure until the operator attempts to lower the closure 20. The sudden drop will indicate cable failure. Because the drop will only be a short distance, the closure 20 can be lowered completely with ease once the tension is returned to the remaining intact cable 22 or 24.

Figure 3:
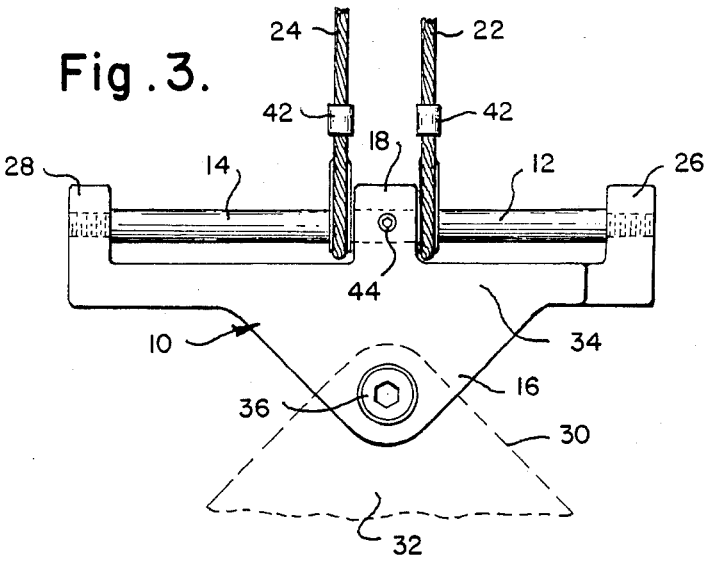
FIG. 3 is a front elevational view of the connecting member of the invention.

The configuration of device 10 as illustrated in FIG. 3 provides clearance for arms 12 and 14 to pivot. Any other configuration which permits suitable pivoting of the arms 12 and 14 in the event of a cable failure will suffice and is within the scope of the claimed invention. Similarly, counterweight 30 may assume the configuration and mass required by the specific application without exceeding the scope of the claimed invention.

What is claimed is:

1. In a system for assisting the vertical movement of a closure wherein a counterweight for balancing the closure is suspended from each of two cables in a redundant cable system, a device for indicating the failure of one or more of the cables comprising:

a member having two arms for so connecting each of the cables to the counterweight that the counterweight is maintained at a first distance from the closure when all cables are intact and the counterweight so moves to a second distance from the closure when at least one of the cables fails that the counterweight can move into a position for inhibiting the raising of the closure, thereby indicating the failure of one of the cables, said second distance being greater than said first distance;

each of said arms being adapted for sliding attachment to one of the cables; said member being so pivotally connected to the counterweight that the cables maintain said arms in such a generally horizontal position when both cables are intact, that the counterweight is maintained at said first distance, and one of the cables so slides along the one of said arms to which it is attached when the other of the cables fails, that said member pivots, moving said arms toward such a generally vertical position that the counterweight moves to said second distance.

2. A device recited in claim 1 wherein said inhibiting position is one in which the counterweight comes to so rest on a horizontal surface that the balancing effect of the counterweight on the closure is eliminated when the closure is raised to less than said second distance from the counterweight.

3. In a system for assisting the vertical movement of a closure wherein the system includes a redundant cable system having two cables, the improvement of a device for indicating the failure of one of the cables comprising:

a counterweight for balancing the closure suspended from each cable;

a member having two arms for so connecting said counterweight to each of the cables that said counterweight is maintained at a first distance from the closure when both cables are intact and said counterweight so moves to a second distance from the closure when one of the two cables fails that said counterweight can move into a position for inhibiting the raising of the closure, thereby indicating the failure of one of the cables, said second distance being greater than said first distance;

each of said arms being adapted for sliding attachment to one of the cables, said member being so pivotally connected to the counterweight that the cables maintain said arms in such a generally horizontal position when both cables are intact, that the counterweight is maintained at said first distance, and one of the cables so slides along the one of said arms to which it is attached when the other of the cables fails, that said member pivots, moving said arms toward such a generally vertical position that the counterweight moves to said second distance; and means for preventing the cable on one of said arms from sliding onto the other of said arms.

4. A device as recited in claim 3 wherein said preventing means is a midsection which separates said arms.

* * * * *